US006312318B1

(12) United States Patent
Mushardt et al.

(10) Patent No.: US 6,312,318 B1
(45) Date of Patent: Nov. 6, 2001

(54) METHOD AND MACHINE FOR CENTERLESS ANGULAR PLUNGE GRINDING

(75) Inventors: Heinrich Mushardt, Neu-Boernsen; Ingo Rauch, Stuttgart, both of (DE)

(73) Assignee: Schaudt Mikrosa BWF GmbH, Stuttgart (DE)

( * ) Notice: Subject to any disclaimer, the term of this patent is extended or adjusted under 35 U.S.C. 154(b) by 0 days.

(21) Appl. No.: 09/648,206

(22) Filed: Aug. 25, 2000

(30) Foreign Application Priority Data

Aug. 27, 1999 (DE) ..... 199 40 685

(51) Int. Cl.[7] ..... B24B 1/00

(52) U.S. Cl. ..... 451/49; 451/51; 451/177; 451/242; 451/397; 451/407

(58) Field of Search ..... 451/49, 51, 177, 451/242, 397, 407

(56) References Cited

U.S. PATENT DOCUMENTS 4,062,150 * 12/1977 Masuda et al. ..... 451/49
4,083,151 * 4/1978 Jessup et al. ..... 451/242
4,192,102 * 3/1980 Jessup ..... 451/242

FOREIGN PATENT DOCUMENTS 40 02 632 C2 9/1995 (DE) .
0 548 957 A1 6/1993 (EP) .

* cited by examiner

*Primary Examiner*—Joseph J. Hail, III
*Assistant Examiner*—Shantese McDonald
(74) *Attorney, Agent, or Firm*—Weingarten, Schurgin, Gagnebin & Hayes LLP

(57) ABSTRACT

A method and a grinding machine for centerless angular plunge grinding a workpiece are disclosed. The workpiece is rotatable about a first axis and has essentially cylindrical sections of different diameter and at least one shoulder located between the sections. The grinding wheel has a conically shaped periphery and is rotated about its axis inclined relative to the workpiece axis by a predetermined angle. The grinding wheel is brought into engagement with the workpiece with at least an axial surface line of its periphery. The grinding wheel and the workpiece are fed-in relative to one another by a predetermined amount of overmeasure. The feeding-in is effected in at least two steps. In a first step the feeding-in is effected essentially in a radial direction. In a second step the feeding-in is effected essentially in an axial direction. In the first step essentially the overmeasure in the area of the cylindrical sections is removed. In the second step essentially the overmeasure of the shoulder is removed.

19 Claims, 3 Drawing Sheets

34
35
16
70
68
66
72
80
86
84
74/1
74/2
82
88
50
52
54
A1
A2
A
P72
P72/1
P72/2
P73
P74
P75

METHOD AND MACHINE FOR CENTERLESS ANGULAR PLUNGE GRINDING

CROSS REFERENCE TO RELATED APPLICATIONS

Reference is made to a first patent application of the same applicant of even date entitled "A grinding machine for centerless grinding of workpieces" (Attorney's Docket 4820P100US) and to a second patent application of the same applicant of even date entitled "A method and an apparatus for CNC-controlled dressing of a regulating wheel of a grinding machine for a centerless grinding process on a workpiece, a method for centerless grinding and a grinding machine" (Attorney's Docket 4828P101US), the disclosure of these co-pending applications being incorporated into this application by way of reference.

FIELD OF THE INVENTION

The present application generally relates to the field of grinding workpieces.

More specifically, the invention is related to a method for centerless angular plunge grinding a workpiece rotatable about a first axis and having essentially cylindrical sections of different diameter and at least one shoulder located between the sections, wherein a grinding wheel having a conically shaped periphery is rotated about its axis inclined relative to the workpiece axis by a predetermined angle and is brought into engagement with the workpiece along at least an axial surface line of its periphery, and wherein, further, the grinding wheel and the workpiece are fed-in relative to one another by a predetermined amount of overmeasure.

The invention is, further, related to a grinding machine for centerless angular plunge grinding a workpiece rotatable about a first axis and having essentially cylindrical sections of different diameter and at least one shoulder located between the sections, wherein a grinding wheel having a conically shaped periphery is adapted to be rotated about its axis inclined relative to the workpiece axis by a predetermined angle and is adapted to be brought into engagement with the workpiece along at least an axial surface line of its periphery, and wherein, further, the grinding wheel and the workpiece are adapted to be fed-in relative to one another by a predetermined amount of overmeasure.

BACKGROUND OF THE INVENTION

A method and a grinding machine of the type specified above are well-known in the art.

During the centerless grinding, it is conventional to position a rotatable workpiece on a support between a grinding wheel and a regulating wheel. The grinding wheel is brought into engagement on a peripheral surface of the workpiece while the latter is simultaneously supported by the regulating wheel.

In this context, it is further known to machine workpieces by angular plunge grinding. During angular plunge grinding, the grinding wheel axis is inclined relative to the longitudinal axis of the workpiece by a predetermined angle. The outer periphery of the grinding wheel is conical in this situation, such that the surface line of the conical section of the grinding wheel e.g. extends parallel to the axis of the workpiece which, in turn, makes it possible to grind cylindrical peripheries.

In this context it is, further, known to grind workpieces having axial sections of different diameters. Between these diameters are shoulders being either configurated as annular shoulders having surfaces extending in a radial plane or having inclined shoulders with conical surfaces but, in both cases, interconnecting cylindrical sections of different diameter.

For the angular plunge grinding of such workpieces, it is known to axially support the workpieces on the support rail, i.e. to push the workpieces against an axial stop during angular plunge grinding.

In conventional centerless angular plunge grinding, the grinding wheel is fed-in in a direction being inclined to the workpiece axis for removing a predetermined overmeasure on the periphery of the workpiece. In this context, it is known to align the workpiece together with the support in an orientation being inclined to the longitudinal median plane of the grinding machine, namely on a slide that may be displaced in a direction extending under right angles to the workpiece axis. The regulating wheel, in turn, is disposed on a second slide being arranged on the afore-mentioned first slide and being adapted to be displaced parallel to the feed-in direction of the latter, enabling to push the regulating wheel against the workpiece in a radial direction relative to the workpiece axis. In this prior art grinding machines, the grinding spindle is rigidly attached to the machine bed. The rotational axis of the grinding wheel extends parallel to the longitudinal median plane of the grinding machine. The grinding wheel is configurated conically at its periphery, the cone angle being exactly the same as the angular inclination of the workpiece relative to the longitudinal median plane of the grinding machine.

In this prior art approach, there is the risk that the grinding wheel will come into engagement only with the overmeasure in the area of the shoulder at the beginning of the process and will, hence, remove this overmeasure, whereas it does not come into contact with the cylindrical section of the workpiece overmeasure. As a consequence, a non-defined relative position may develop between the workpiece, the regulating wheel, the grinding wheel and the support rail which under the action of the grinding pressure acting against the shoulder, may result in a sudden movement of the workpiece and, hence, in undesired movements. Moreover, the drive effecting the rotation of the workpiece via the regulating wheel may not be guaranteed in this situation due to the very low radial force exerted solely via the grinding wheel contact to the workpiece shoulder.

Moreover, the prior art approach has the disadvantage that the amount of overmeasure in the area of the cylindrical sections and in the area of the shoulder are depending on one another, namely over the inclined angle under which the grinding wheel and the workpiece are fed-in relative to one another.

EP 0 548 957 A1 discloses a method and a grinding machine for centerless grinding workpieces having a stepped diameter. The cylindrical sections of different diameter are ground by separate grinding wheels, wherein the separate grinding wheels are driven separately. By appropriately setting the rotational speed, the peripheral speeds and, hence, the cutting speeds of the grinding wheels may be made equal in spite of the different diameters of the grinding wheels. According to this prior art method, an approach is disclosed relating to the grinding of shoulder sections in such stepped workpieces. In an example, a workpiece is ground having a cylindrical section of a smaller diameter, a cylindrical section of larger diameter as well as a rounded shoulder configurating a transition therebetween. For centerless grinding this workpiece, a grinding wheel of complementary shape is utilized. In a first machining step, the grinding wheel is approached to the workpiece in a radial direction by feeding-in the regulating wheel accordingly. As a result, the grinding wheel comes into engagement with the workpiece section of larger diameter first, namely with the grinding wheel of smaller diameter. The feeding-in continues until the grinding wheel contacts the workpiece over its entire length. The grinding wheel is then displaced in an axial direction until the final dimensions of the workpiece are attained. Therefore, this prior art method is not an angular plunge grinding process and an axial feed-in movement of the grinding wheel is only effected during the last method step whereas the radial feed-in movement is not effected by the grinding wheel, but by the regulating wheel instead.

DE 40 02 632 C2 generally teaches that during centerless cylindrical grinding, the grinding wheel may either be fed-in solely radially or solely axially or simultaneously radially and axially, and that feeding-in movements may also be effected through the regulating wheel.

It is, therefore, an object underlying the invention to improve a method and a grinding machine of the type specified at the outset such that the disadvantages mentioned before are avoided.

In particular, a safe position support and contact of the workpiece shall be guaranteed at any time so that only one well-defined movement of the workpiece is possible. Moreover, it shall be ensured that the workpiece is applied against the regulating wheel to a sufficient extent by a corresponding radial force, thus guaranteeing the rotational drive of the workpiece. Finally, it shall be possible to separately set the amount of overmeasure in the area of the cylindrical sections of the workpiece and of the shoulder, depending on the particular application.

SUMMARY OF THE INVENTION

According to the method specified at the outset, this object is achieved in that the feeding-in is effected in at least two steps, wherein in a first step, the feeding-in is effected essentially in a radial direction, and in a second step, the feeding-in is effected essentially in an axial direction, such that in the first step essentially the overmeasure in the area of the cylindrical sections is removed and in the second step essentially the overmeasure of the shoulder is removed.

According to the grinding machine specified at the outset, this object is achieved in that means are provided for feeding-in in at least two steps, wherein in a first step the feeding-in is effected essentially in a radial direction and in a second step, the feeding-in is effected essentially in an axial direction, such that in the first step essentially the overmeasure in the area of the cylindrical sections is removed and in the second step essentially the overmeasure of the shoulder is removed.

The object underlying the invention is thus entirely solved.

By subdividing the feeding-in movement in two steps, one can first essentially feed-in in a radial direction so that the above-described problems of a non-defined position and a non-defined movement of the workpiece relative to the grinding wheel, relative to the support and relative to the regulating wheel may not occur. Moreover, by doing so it is possible to separately set the amount of overmeasure in the area of the cylindrical sections and in the area of the shoulder because these two removal steps are effected one after the other.

However, according to a preferred embodiment of the invention, it is also possible that in the second step a radial component of movement is superimposed over the feeding-in movement, such that also in the second step an overmeasure in the area of the cylindrical sections is removed.

This measure has the advantage that also during the second step a radial force is exerted on the workpiece so that also during the second step, a safe contact between the workpiece and the regulating wheel is guaranteed.

According to another variation of the invention, a first intermediate step is executed after the first, wherein in the first intermediate step, the grinding wheel is again moved away from the workpiece in an essentially radial direction, wherein, further, after the second step, a second intermediate step is executed, in which the grinding wheel is again moved towards the workpiece in an essentially radial direction.

This measure has the advantage that by further differentiating the feeding-in movement, various areas of the workpiece may be approached in a predetermined manner and that the amount of overmeasure in these areas is removed during different steps and, hence, differently.

In preferred embodiments of the invention, the angle is dimensioned between 10° and 30°.

This range of dimension has shown to be optimal in practice.

In further preferred embodiments of the invention, the workpiece axis is held stationary and the grinding wheel is moved in a radial and in an axial direction relative to the workpiece axis.

This measure has the advantage that the required grinding machine may be designed simply because by means of a cross slide or the like, the sequence of movements of the grinding wheel and, hence, all of the relative movements between the grinding wheel and the workpiece may be executed.

The feeding-in movements of the grinding wheel relative to the workpiece is, preferably, effected by superpositioning slide movements, wherein all conceivable permutations of axial directions are possible.

Further advantages become apparent from the description and the enclosed drawing.

It goes without saying that the features mentioned before and those that will be explained hereinafter may not only be used in the particular given combination, but also in other combinations or alone without leaving the scope of the present invention.

BRIEF DESCRIPTION OF THE DRAWINGS

Embodiments of the invention are shown in the drawing and will be discussed in further detail in the subsequent description.

DETAILED DESCRIPTION OF THE PREFERRED EMBODIMENTS

Figure 1:
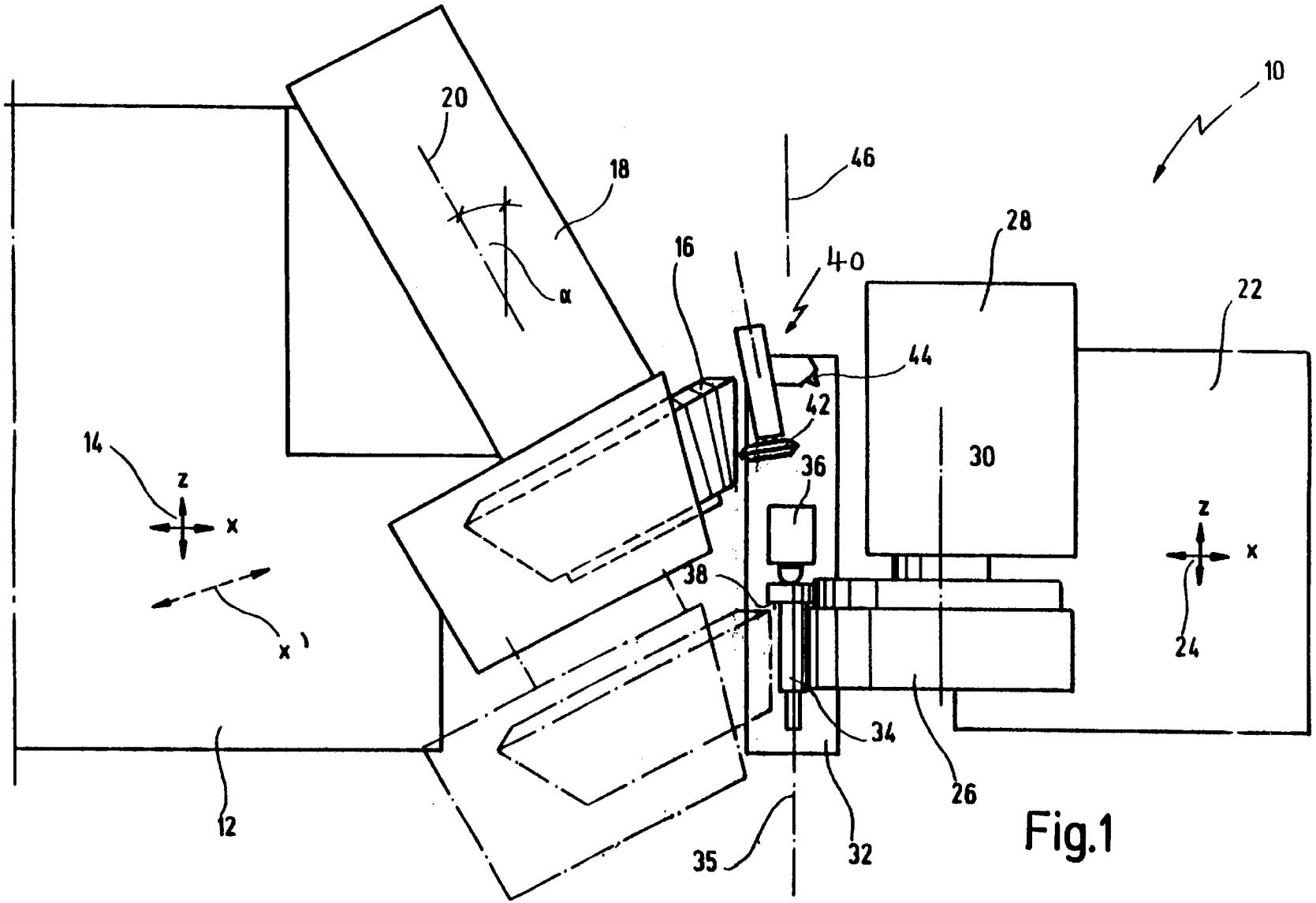
FIG. 1 shows a highly schematic top plane view on an embodiment of a grinding machine according to the present invention.

In FIG. 1, reference numeral 10 as a whole designates a grinding machine for centerless angular plunge grinding.

Grinding machine 10 comprises a first slide 12 being configurated as a cross-slide. First slide 12 is adapted to be displaced linearly along the axes indicated at 14, i.e. along the so-called Z-axis and the so-called Y-axis.

A grinding wheel 16 together with its associated drive 18 is mounted on first slide 12. An axis 20 of drive 16 is inclined relative to the Z-axis, namely by an angle $\alpha$. The angle $\alpha$, preferably, is in the range of between 10° and 30°.

Grinding machine 10, further, comprises a second slide 22 being likewise configurated as a cross slide and, hence, is adapted to be displaced along axis indicated at 24, namely along the Z-axis and along the X-axis. As indicated in FIG. 1 by X' and a dashed double arrow, first slide 12 may insofar also be adapted to be displaced along an axis not extending under right angles relative to the longitudinal axis of grinding machine 10. Second slide 22 supports a regulating wheel 26 together with its associated drive 28. The axis of regulating wheel 26 is indicated at 30.

A support 32 for a workpiece 34 is positioned between slides 12 and 22. Workpiece 34 is of rotational symmetric shape and has a longitudinal axis 35. Workpiece 34 in an axial direction rests against an axial stop 36 at the upper end in FIG. 1. Stop 36 for that purpose may have a spherical or a rotatable contact surface for workpiece 34.

It is, further, important that workpiece 34 is provided with a shoulder that may extend either radially or conically.

Finally, FIG. 1 shows a dressing assembly 40 comprising a first dressing tool 42 for grinding wheel 16 as well as a second dressing wheel 44 for dressing regulating wheel 26.

In the embodiment shown, dressing assembly 40 is positioned on support 32 and is, hence, stationary. By appropriately displacing slides 12 and 22 along axes 14 and 24, respectively, a dressing operation may be effected. FIG. 1 shows in solid lines that grinding wheel 16 was approached with its periphery to first dressing tool 42 by displacement along axis 14 in order to enable a conventional dressing operation to be executed at that position. In FIG. 1, further, dash-dot lines show a situation in which grinding wheel 16 is in engagement on workpiece 34 or is just in the process of being fed-in towards workpiece 34, respectively.

In FIG. 1, reference numeral 46 designates a longitudinal median plane extending parallel to the Z-axis. Slides 12 and 22 are positioned on opposite sides of longitudinal median plane 46. Workpiece 34 is positioned on support 32 and, essentially, along longitudinal median plane 46.

Figures 2A, 2B:
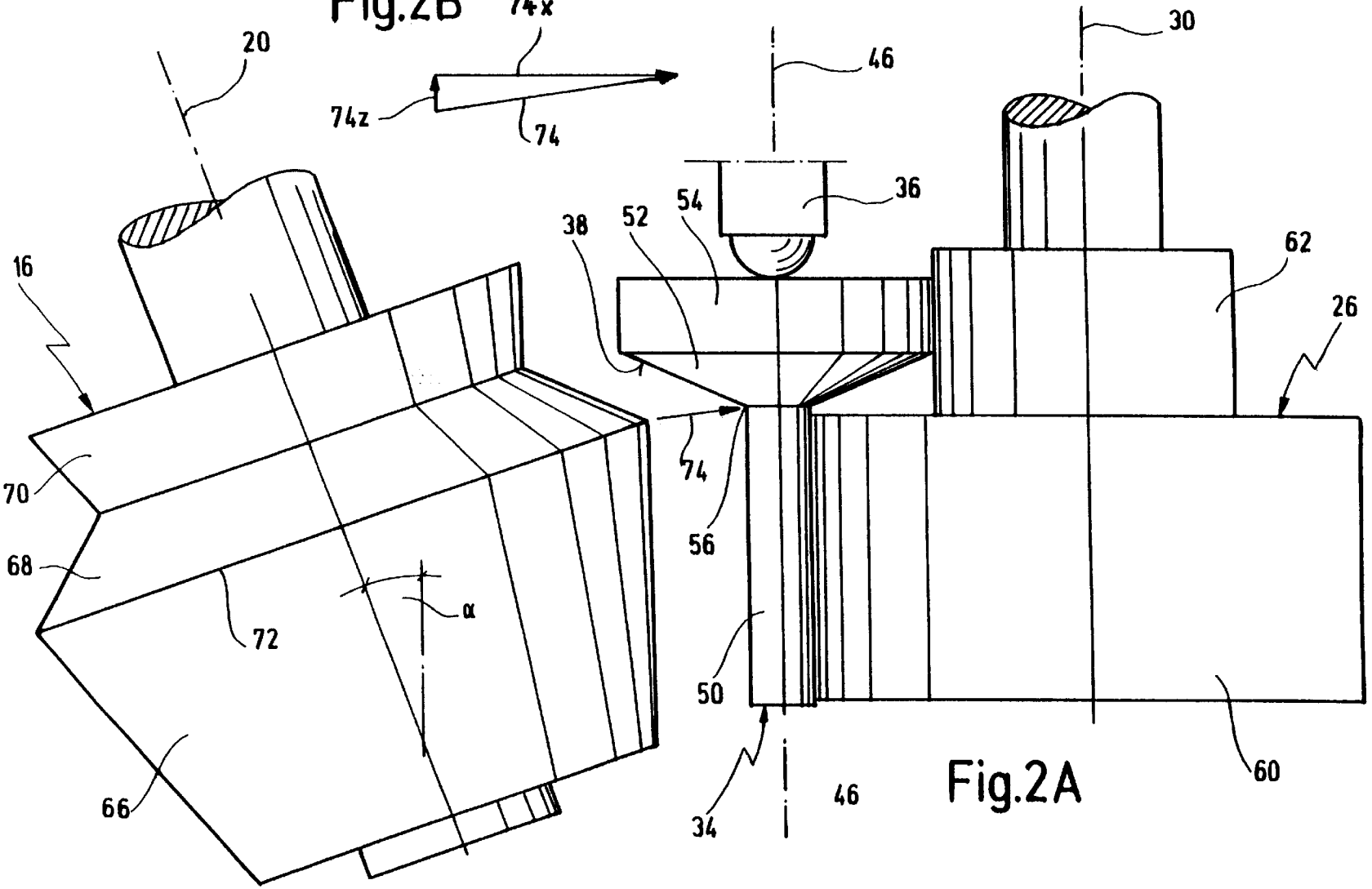
FIG. 2A shows a partial view of FIG. 1 on a highly enlarged scale.
FIG. 2B shows a vector diagram for explaining the arrangement of FIG. 2A.

In the detailed depiction of FIG. 2A, the situation in the area of workpiece 34 is again shown in further detail.

As one may see first, workpiece 34 has a thinner cylindrical section 50, a conical transitional section 52 as well as a thicker cylindrical section 54. Conical section 52, hence, configurates a shoulder between cylindrical sections 50 and 54. Conical section 52 is to be understood only as an example, because also a radial annular shoulder might be provided instead. The transition between sections 50 and 52 is designated with reference numeral 56.

Regulating wheel 26, correspondingly, is provided with a larger cylindrical section and a smaller cylindrical section 62. Sections 60 and 62 contact cylindrical sections 50 and 54 of workpiece 34.

Grinding wheel 16 in its outer shaper is matched to the outer shape of workpiece 34. Depending on angle $\alpha$, grinding wheel 16 has a first conical section 66, a second conical section 68 as well as a third conical section 70. These sections are configured such that they may just be brought in contact with sections 50, 52 and 54 of workpiece 34 while surface lines of sections 50/66, 52/68 and 54/70, respectively, are in contact with each other. On grinding wheel 16, the transition between sections 66 and 68 is designated by reference numeral 72.

In order to grind workpiece 34, grinding wheel 16 would have to be approached towards workpiece 34 from the position shown in FIG. 2A along an arrow 74 and would then have to be fed-in by the desired overmeasure.

Arrow 74 shows that the direction of approaching and feeding-in extends inclined relative to longitudinal median plane 46. As shown in FIG. 2B, arrow 74 may, hence, be represented by a radial component 74$x$ along the X-axis together with an axial component 74$z$ along the Z-axis.

According to the present invention, the feed-in movement is effected in several steps, wherein during each such step the feed-in is either mostly axial or radial.

Figures 3A, 3B, 4A, 4B, 5A, 5B, 5C, 5D:
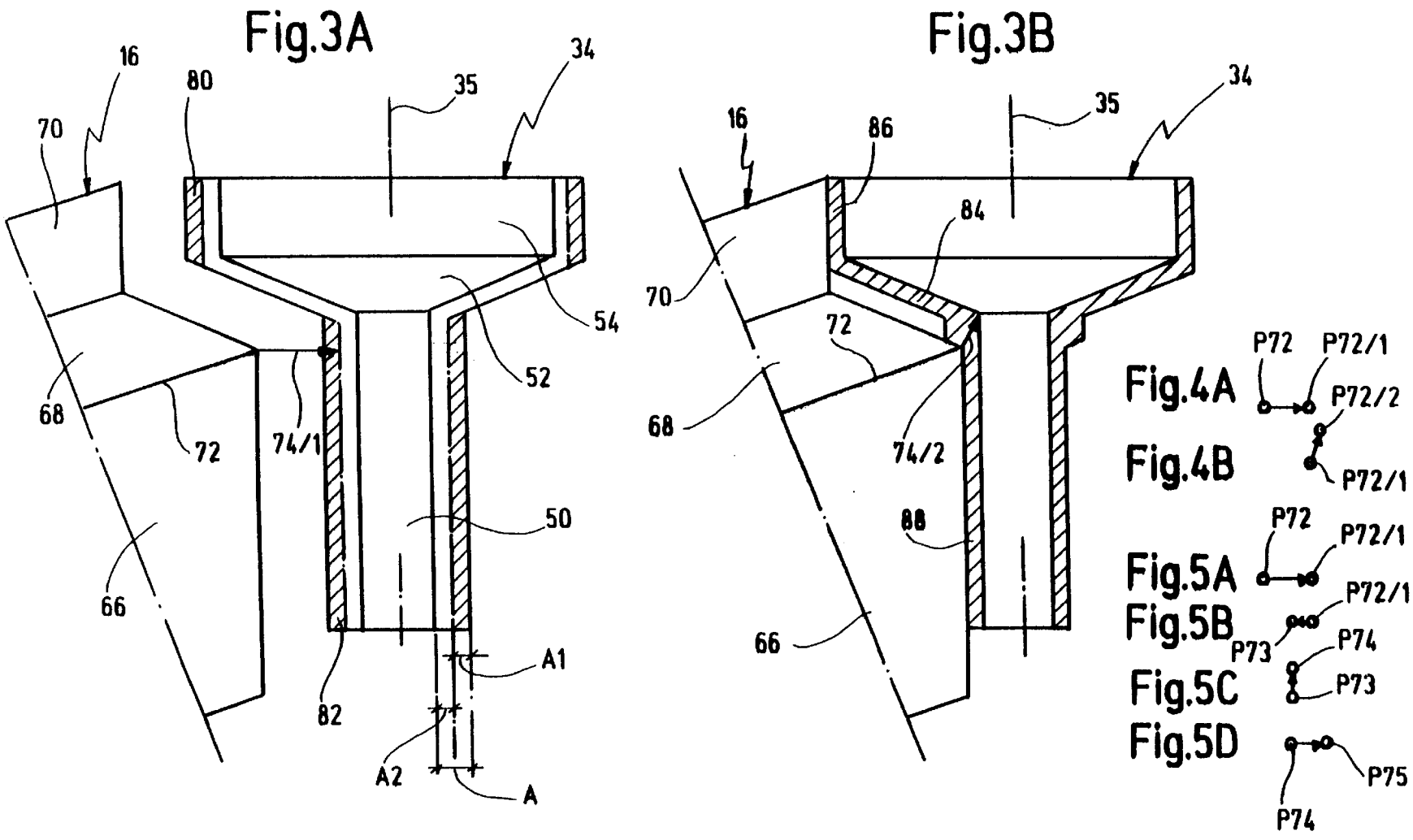
FIGS. 3A and 3B show another schematic drawing for clarifying the method according to the present invention during two different method steps.
FIGS. 4A and 4B show the approach of FIGS. 3A and 3B in a further schematic depiction.
FIGS. 5A through 5D show an illustration similar to that of FIGS. 4A and 4B for explaining a variation of the method shown therein.

This is further exemplified in FIGS. 3A and 3B.

From FIG. 3A, one may take that workpiece 34 has an entire overmeasure A which, according to the present invention, is subdivided into two partial overmeasures A1 and A2.

In a first feed-in step, grinding wheel 16 is fed-in in a radial direction towards workpiece 34 as indicated by an arrow 74/1 in FIG. 3A. Accordingly, sections 66 and 70 essentially first come into engagement with overmeasure areas 80 and 82 on sections 50 and 54. In a second method step according to FIG. 3B, the feed-in is effected essentially in an axial direction as indicated by an arrow 74/2. This feed-in movement may be effected exactly axially, however, it may also comprise a certain radial component, as shown in FIG. 3B. By doing so, essentially an overmeasure 86 on section 52 of workpiece 34 is removed and, if a certain radial component is provided, further overmeasures 86 and 88 are removed in the areas 50 and 54.

Accordingly, the result is that during the first step according to FIG. 3A, workpiece 34 is first exposed to a load essentially in a radial direction so that a well-defined position and movement of workpiece 34 on its support 32 is guaranteed as well as a secure contact with regulating wheel 26.

The afore-described method is again further schematically depicted in FIG. 4A and 4B. P72 and P72/1 symbolize the movement of the grinding wheel in the area of transition 72. This movement, according to FIG. 4A is exactly radial and leads to P72/1. In the second step according to FIGS. 3B and 4B, respectively, grinding wheel 16 is displaced essentially axially from P72/1 to P72/2.

A still more refined variation is shown in FIGS. 5A to 5B in a depiction similar to that of FIGS. 4A and 4B.

Accordingly, grinding wheel 16 or periphery 72, respectively, are likewise fed-in during the first step in a radial direction from P72 to P72/1. However, an intermediate step is now inserted according to FIG. 5B during which the grinding wheel is again withdrawn from P72/1 by a small amount, namely back to P73, which means away from workpiece 34. From this retracted position, another axial feed-in movement is effected according to FIG. 5C from P73 to P74. Thereafter, a further intermediate step according to FIG. 5D is provided during which the grinding wheel is again fed-in in a radial direction from P74 to P75.

By doing so, it is possible to exactly grind away the overmeasure in the area of the transitions between section 50 and 52 as well as between 52 and 54.

What is claimed is:

1. A method for centerless angular plunge grinding a workpiece having a first axis, said workpiece being rotatable about said first axis and having essentially cylindrical sections of different diameter and at least one shoulder located between said sections, wherein a grinding wheel has a second axis inclined relative to said first axis by a predetermined angle and has a conically shaped periphery, the method comprising the steps of:

a) rotating said grinding wheel about said second axis;

b) bringing said grinding wheel into engagement with said workpiece along at least an axial surface line of said periphery;

c) feeding-in said grinding wheel and said workpiece relative to one another by a predetermined amount of overmeasure, said feeding-in being effected in at least two steps, wherein in a first step said feeding-in is effected essentially in a radial direction and in a second step said feeding-in is effected essentially in an axial direction, such that in said first step essentially said overmeasure in an area of said cylindrical sections is removed and in said second step essentially said overmeasure of said shoulder is removed.

2. The method of claim 1, wherein in said second step a radial component of movement is superimposed over said feeding-in movement, such that also in said second step an overmeasure in said area of said cylindrical sections is removed.

3. The method of claim 1, wherein after said first step a first intermediate step is executed, in which said grinding wheel is again moved away from said workpiece in an essentially radial direction, and after said second step a second intermediate step is executed, in which said grinding wheel is again moved towards said workpiece in an essentially radial direction.

4. The method of claim 1, wherein said angle is dimensioned between 10° and 30°.

5. The method of claim 1, wherein said first axis is held stationary and said grinding wheel is moved in a radial and in an axial direction relative to said first axis.

6. The method of claim 1, wherein said feed-in movement of said grinding wheel relative to said workpiece is effected by superpositioning slide movements.

7. The method of claim 6, wherein a first slide movement is effected under right angles relative to said first axis.

8. The method of claim 6, wherein a first slide movement is effected under an acute angle relative to said first axis.

9. The method of claim 6, wherein a second slide movement is effected parallel to said first axis.

10. A grinding machine for centerless angular plunge grinding a workpiece having a first axis, said workpiece being rotatable about said first axis and having essentially cylindrical sections of different diameter and at least one shoulder located between said sections, wherein a grinding wheel has a second axis inclined relative to said first axis by a predetermined angle and has a conically shaped periphery, the grinding machine comprising:

a) means for rotating said grinding wheel about said second axis;

b) means for bringing said grinding wheel into engagement with said workpiece along at least an axial surface line of said periphery;

c) means for feeding-in said grinding wheel and said workpiece relative to one another by a predetermined amount of overmeasure, said feeding-in being effected in at least two steps, wherein in a first step said feeding-in is effected essentially in a radial direction and in a second step said feeding-in is effected essentially in an axial direction, such that in said first step essentially said over-measure in an area of said cylindrical sections is removed and in said second step essentially said overmeasure of said shoulder is removed.

11. The grinding machine of claim 10, wherein in the second step a radial component of movement is adapted to be superimposed over said feeding-in movement, such that also in said second step an overmeasure in said area of said cylindrical sections is removed.

12. The grinding machine of claim 10, wherein after said first step a first intermediate step is adapted to be executed, in which said grinding wheel is again moved away from said workpiece in an essentially radial direction, and after said second step a second intermediate step is adapted to be executed, in which said grinding wheel is again moved towards said workpiece in an essentially radial direction.

13. The grinding machine of claim 10, wherein said angle is dimensioned between 10° and 30°.

14. The grinding machine of claim 10, wherein said first axis is stationary and said grinding wheel is adapted to be moved in a radial and in an axial direction relative to said first axis.

15. The grinding machine of claim 10, wherein said grinding wheel and said workpiece are adapted to be moved relative to one another by superpositioning slide movements.

16. The grinding machine of claim 15, wherein a slide is displaceable along a third axis extending under right angles relative to said first axis.

17. The grinding machine of claim 15, wherein a slide is displaceable along a third axis extending under an acute angle relative to said first axis.

18. The grinding machine of claim 15, wherein a slide is displaceable along a fourth axis extending parallel to said first axis.

19. The grinding machine of claim 16, wherein said slide carries said grinding wheel.

* * * * *